US005582216A

United States Patent [19]

Smith et al.

[11] Patent Number: 5,582,216

[45] Date of Patent: Dec. 10, 1996

[54] APPARATUS AND METHOD FOR INSTALLING WIRE FENCING

[76] Inventors: Michael T. Smith, 336 Wheeler Ford Rd.; Barry K. Cole, 1086 Old Cedartown Rd., both of Rockmart, Ga. 30153

[21] Appl. No.: 339,089

[22] Filed: Nov. 14, 1994

[51] Int. Cl.[6] ..... B21F 29/00

[52] U.S. Cl. ..... 140/107; 140/16; 242/557

[58] Field of Search ..... 140/16, 37, 38, 140/107, 108; 242/557, 594.3

[56] References Cited

U.S. PATENT DOCUMENTS

| | | | |
|---|---|---|---|
| 337,119 | 3/1886 | Bigelow | 140/16 |
| 1,214,772 | 2/1917 | Fouts . | |
| 1,353,304 | 9/1920 | Ahlstrom | 242/557 |
| 2,789,778 | 4/1957 | Zogg et al. | 242/594.3 |
| 2,914,270 | 11/1959 | Parker et al. | 242/86.5 |
| 3,048,348 | 8/1962 | Griffin | 242/86.5 |
| 3,934,655 | 1/1976 | Whistle | 173/46 |
| 4,208,021 | 6/1980 | Wall | 242/557 |
| 4,473,196 | 9/1984 | Sammann et al. | 242/86.5 |
| 4,775,114 | 10/1988 | Farnsworth | 242/86.5 |
| 4,854,521 | 8/1989 | Farnsworth | 242/86.5 |
| 5,042,737 | 8/1991 | Sigle et al. | 242/86.5 |
| 5,186,410 | 2/1993 | Toews | 242/557 |
| 5,285,981 | 2/1994 | Pavelka | 242/86.5 |

FOREIGN PATENT DOCUMENTS

| | | | |
|---|---|---|---|
| 700606 | 12/1964 | Canada | 242/557 |

*Primary Examiner*—Lowell A. Larson
*Attorney, Agent, or Firm*—Jones & Askew

[57] ABSTRACT

An apparatus and method for installing wire fencing including a support frame drawn by a conveyance and supporting an upstanding wire unit support spindle. A plurality of wire fencing units which may include one or and a combination of one or more wire fencing balls or spools of stranded wire fencing or a roll of field fencing are placed coaxially about the upstanding support spindle. Separator plates are placed between the wire fencing units and then the free wire ends are attached to a fence posts. The conveyance moves along a line of fence posts and the wire fencing of each of the wire fencing units is simultaneously dispensed. A drag assembly applies a drag force against a portion of the support spindle to prevent uncontrolled pay-out of the wire fencing as the wire is dispensed. A clamp assembly, selectively engagable with portions of the payed-out is provided for isolating pulling tension form wire remaining supported on wire units as the fencing is stretched prior to attachment to the fence posts. A dispensed wire installation post assembly is provided to organize payed-out wire fencing to prevent tangling prior to attaching the payed-out wire fencing to the fence posts.

16 Claims, 7 Drawing Sheets

APPARATUS AND METHOD FOR INSTALLING WIRE FENCING

TECHNICAL FIELD

This invention relates to an apparatus and method for installing wire fencing. More particularly, it relates to an apparatus and method for supporting and paying out wire fencing along a line of fence posts, and for stretching the wire fencing prior to attaching it to the fence posts.

BACKGROUND OF THE INVENTION

Various wire fence installation apparatuses and methods exist to assist in stringing fencing material to enclose farm land and ranches. These apparatuses range from a simple pole inserted through a roll, ball or spool of fencing material to facilitate unwinding fencing along a line of fence posts, to conveyed fence dispensing devices capable of simultaneously dispensing stranded or woven wire fencing from multiple rolls, balls or spools of fencing carried by the dispenser. A typical apparatus of the latter type includes a fencing support frame attached to a conveyance which is typically a tractor. The frame generally includes one or more upstanding, rotating spindles, each spindle supporting a roll or ball of fencing. The fencing is guided as it pays-out from the support frame to cause the payed-out fencing to comport generally with the intended fence post attachment arrangement. Various means are provided for stretching the payed-out portions of wire fencing prior to attaching the fencing to the fence posts including come-alongs and mechanical clamps that allow the wire fencing to be stretched by moving the conveyance. The stretched wire fencing is then attached, under tension, to the fence posts.

As used herein the term "wire fencing" is used to describe fencing material comprising only wire, or substantially wire. These materials are included in two broad categories: stranded fencing and woven wire fencing. Examples of fencing of the stranded category include stranded barbed wire and single strand wire fencing. Single stranded electric fence wiring is a common type of single strand wire fencing. Stranded fencing is most commonly supplied supported on a central supporting spool or wound in a ball without a central supporting spool.

The second category of fencing material, woven wire fencing, includes bonded field fencing which is characterized by generally rectangular openings Formed by crossed, orthogonally disposed wire strands, welded, or otherwise mechanically bonded, at the points of intersection of the wire strands. Other examples of woven wire fencing include common chicken wire fencing and chain link fencing. Woven wire fencing is typically supplied in rolls without a central spool or tube former. The central aperture of wire fencing rolls, spools and balls is typically about four inches or greater. Individual spools, rolls and balls of wire fencing are often referred to, generally, as fencing wire units.

The wire fencing dispensing devices currently available tend to be mechanically complicated and difficult to operate. For example, it is often desirable to simultaneously string a complement of courses of wire fencing including stranded wire fencing, barbed wire for example, and a course of woven wire fencing. Although there are wire fencing dispensers available that allow the simultaneous stringing of stranded and woven wire fencing, these dispensers tend to be difficult to operate owing to their complicated design and the many adjustments necessary for their use. The prior art devices are typically multi-spindled devices where each spindle carries a single wire fencing unit and, consequently, has associated with each spindle, an anti-backlash and tensioning arrangement to insure controlled payout of the wire as the dispenser is moved along a line of fence posts. These prior art devices also tend to be prohibitively expensive to many who install wire fencing. In addition, the complement of stranded and woven wire fencing capable of being dispensed is either fixed or is difficult to alter with the prior art devices. Therefore, the change-over from one complement of wire fencing to another complement of wire fencing is very time consuming and cumbersome.

Accordingly, there is a need for a wire fencing dispensing and installation device that is relatively inexpensive, easy to use and allows the user to quickly and easily adapt the dispenser for use to dispense and install various complements and arrangements of stranded and woven wire fencing.

SUMMARY OF THE PRESENT INVENTION

The foregoing problems of the prior art wire fencing dispensing and installation apparatuses have been overcome by the wire fencing dispenser and installation apparatus and method of this invention. The wire fencing dispenser and installation apparatus of the present invention provides a versatile device for stringing a desired complement of wire fencing material along a line of fence posts. Generally described, a preferred embodiment of the present invention is an apparatus adapted to be drawn by a conveyance for dispensing wire fencing along a line of fence posts from coiled wire fencing units carried by the apparatus. The coiled wire fencing units are configured to define a unit aperture through the wire fencing unit and have a free wire fencing end attachable to a post of the line of fence posts.

The apparatus further includes a translation support which is engagable with the conveyance and is adapted to be drawn by the conveyance, and a wire support assembly attached to the translation support. The wire support assembly includes a support frame and a spindle assembly supported by the support frame. The spindle assembly comprises a wire fencing unit support for supporting a plurality of coiled wire fencing units and an upstanding spindle adapted to coaxially receive the coiled wire fencing units by extending through the unit aperture of the coiled wire fencing units. The apparatus is capable of simultaneously dispensing wire fencing from a plurality of coiled wire fencing units supported by the spindle assembly by uncoiling the wire fencing from the coiled wire fencing units as the coiled wire fencing units are caused to rotate relative to the support frame in response to the conveyance moving the apparatus past the line of fence posts.

More particularly described, the apparatus of the present invention further includes at least one separator plate disposed between adjacent ones of the plurality of coiled wire fencing units. The separator plate separates adjacent coiled wire fencing units and allows adjacent ones of the coiled wire fencing units to rotate relative to one another in response to the apparatus being conveyed past a line of fence posts by the conveyance.

The wire fencing support assembly may also include a fence brake and guide assembly for guiding the wire fencing during pay-out from the fencing wire units mounted about the spindle assembly. The fence brake and guide assembly is also effective to immobilize the payed-out wire fencing with respect to the spindle assembly so that the payed-out fencing can be stretched prior to attaching the payed-out fencing to the fence posts. A drag assembly may further be included for applying a drag force to the spindle assembly as the spindle assembly rotates while dispensing wire. The drag assembly prevents the wire fencing from paying-out in an uncontrolled manner.

According to another form of the present invention, dispensed wire installation post assemblies are provided to organize the payed-out fencing prior to attaching the wire fencing to fence posts so that the desired organization of the wire fencing is maintained and the fence post attaching process is facilitated.

Generally described, the present invention includes the method of paying out a desired complement of wire fencing along a line of fence posts from coiled wire fencing units having a free end from a fencing dispensing apparatus comprising a support frame and a spindle assembly supported by the support frame. The spindle assembly provided by the method of the present invention comprises a wire fencing unit support for supporting a plurality of coiled wire fencing units and an upstanding spindle adapted to coaxially receive and support a plurality of coiled wire fencing units on the spindle assembly.

More particularly described, the method of the present invention further includes the steps of placing a plurality of coiled wire fencing units about the spindle to be supported by the spindle assembly, securing the free wire fencing end of each of the coiled wire fencing units to a fence post of the line of fence posts and conveying the dispensing apparatus along the line of fence posts in a dispensing direction to simultaneously dispense the wire fencing from the coiled wire units supported by the spindle assembly.

According to another aspect of the present invention, the method further includes the step of placing a separator plate between adjacent coiled wire units supported on the spindle and a drag force may be applied to portions of the spindle assembly during the dispensing step to prevent the uncontrolled pay-out of wire fencing assembly.

The method of the present invention further includes the steps of stretching the dispensed wire fencing and attaching the dispensed wire fencing to the line of fence posts by first immobilizing the dispensed wire with respect to the dispenser by braking portions of the dispensed wire. Then the conveyance is moved in the dispensing direction so that the dispensed wire fencing is placed in a state of proper wire fencing tension.

Furthermore, dispensed wire fencing installation posts may be selectively engaged with the dispensed wire fencing before the step of attaching the dispensed wire to the posts of the line of posts to prevent tangling of the dispensed wire fencing.

Thus it is an object of the present invention to provide a wire fencing dispensing and installation device and method.

It is a further object of the present invention to provide a fencing dispenser and method that allows a fencing installer to dispense a desired complement of wire fencing simultaneously along a line of fence posts.

It is a further object of the present invention to provide a fencing dispenser and method capable of allowing convenient alteration of the complement of wire fencing being payed-out by the dispenser.

It is an object of the present invention to provide a wire fencing and dispensing apparatus and method by providing a dispenser having a single dispensing spindle upon which is mounted a desired complement of wire fencing material, the dispenser being capable of dispensing the wire fencing uniformly and simultaneously.

It is an object of the present invention to provide a wire fencing dispensing and installation apparatus and method that allows units of wire fencing support by a single spindle assembly to rotate independently of adjacent wire units as wire fencing is payed-out from the dispenser.

BRIEF DESCRIPTION OF THE DRAWINGS

Other features of the present invention will be more readily understood from the following detailed description of specific embodiments thereof when read in conjunction with the accompanying drawings in which like reference symbols designate like parts throughout the Figures and in which.

DETAILED DESCRIPTION OF THE PREFERRED EMBODIMENT

Figure 1:
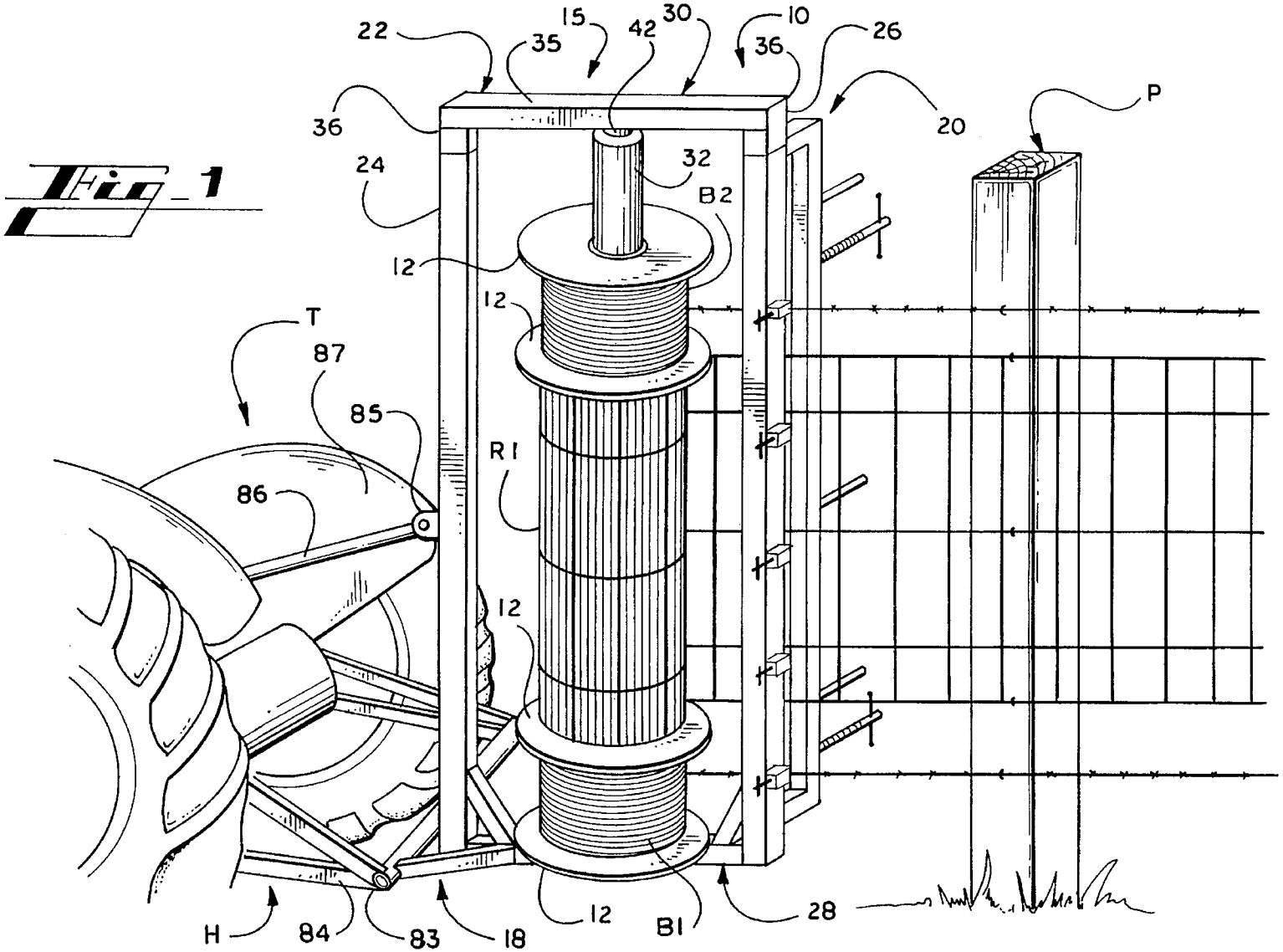
FIG. 1 is a perspective side view of a fencing wire dispensing apparatus according to an embodiment of this invention shown supported by a farm tractor and adapted to payout a complement of stranded wire and woven wire fencing.
Figure 1B:
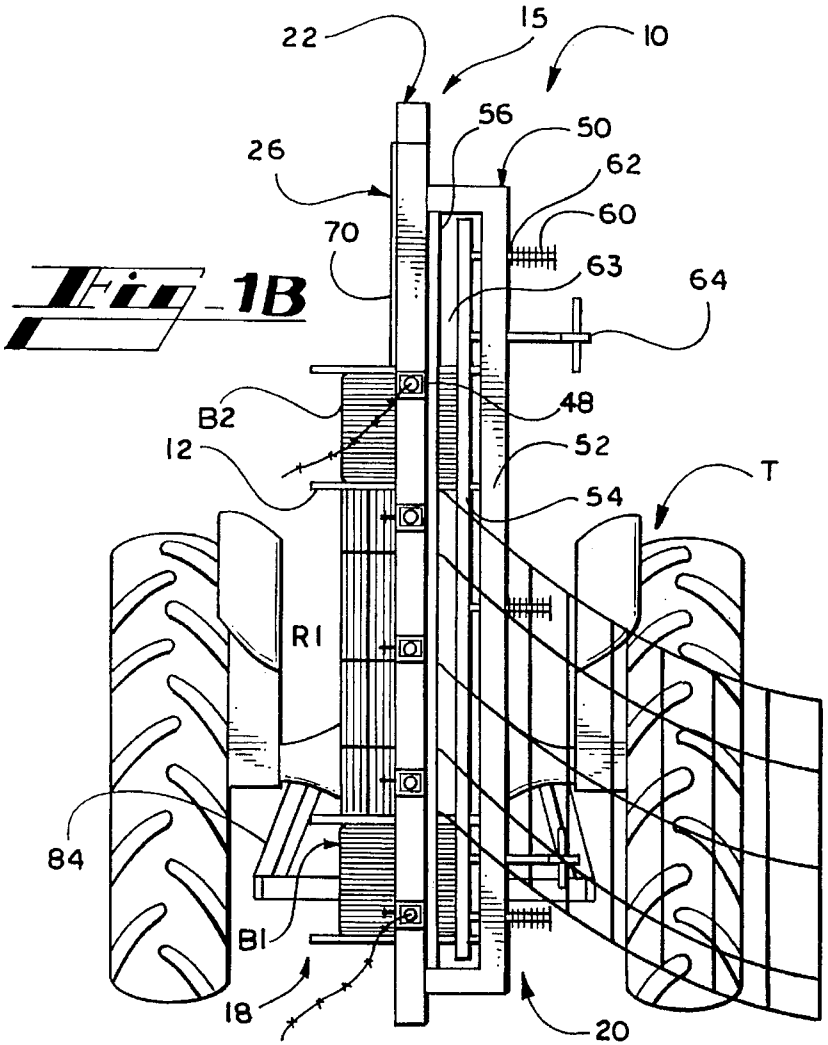
FIG. 1*b* is a perspective rear view of the fencing wire dispenser of FIG. 1*a* shown dispensing a complement of stranded wire units only.
Figure 1A:
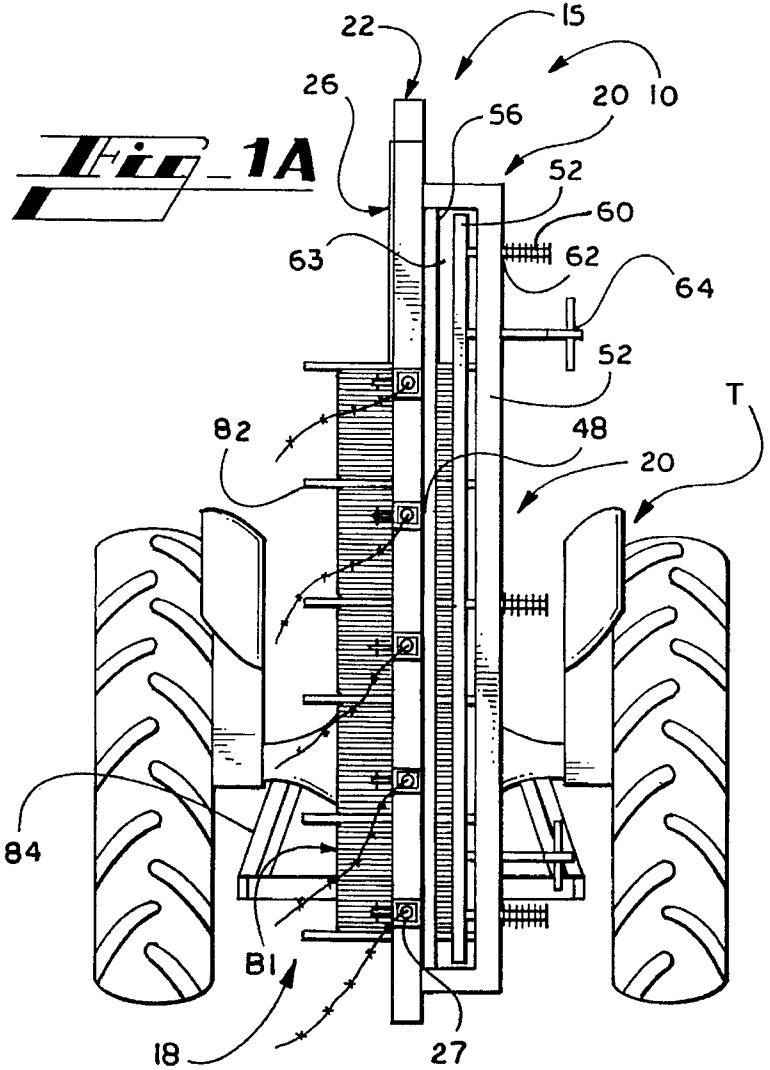
FIG. 1*a* is a perspective rear view of the fencing wire dispensing apparatus shown in FIG. 1.

Referring now to FIGS. 1, 1*a* and 1*b*, there is shown a wire fencing dispensing apparatus according to an embodiment of the present invention, designated generally by the numeral 10 and shown supported by a tractor T. The dispenser 10 is shown dispensing wire fencing from a complement of wire fencing units including a lower most strand of barbed wire from a first ball of barbed wire B1, an intermediate course of woven wire fencing, commonly referred to as field fencing, from a roll R1, and an upper most strand of barbed wire from a second ball of barbed wire, B2. The balls of barbed wire B1 and B2 are separated from the roll R1 by separator plates 12. The wire fencing is shown attached to one of a plurality of fence posts P set in a line along a prescribed fence line. Other complements and arrangements of balled, spooled and rolled wire fencing may be dispensed with the dispenser 10, which will be explained in more detail below.

The dispenser 10 includes a rectangular wire support assembly 15 for supporting the wire fencing to be dispensed, which is adjustably supported by the tractor T through a translation support assembly 18 attached to the support assembly 15. The tractor T engages and supports the dispenser 10 through a tractor hitch assembly H commonly referred to as a three point hitch which mechanically engages the translation support assembly 18.

The dispenser 10 further includes a fence brake and guide assembly 20 attached to the wire support assembly 15 which is effective to prevent further payout of wire fencing from the dispenser 10 when a user desires to tighten the payed-out wire fencing prior to attaching to the fence posts P.

Figures 2, 7:
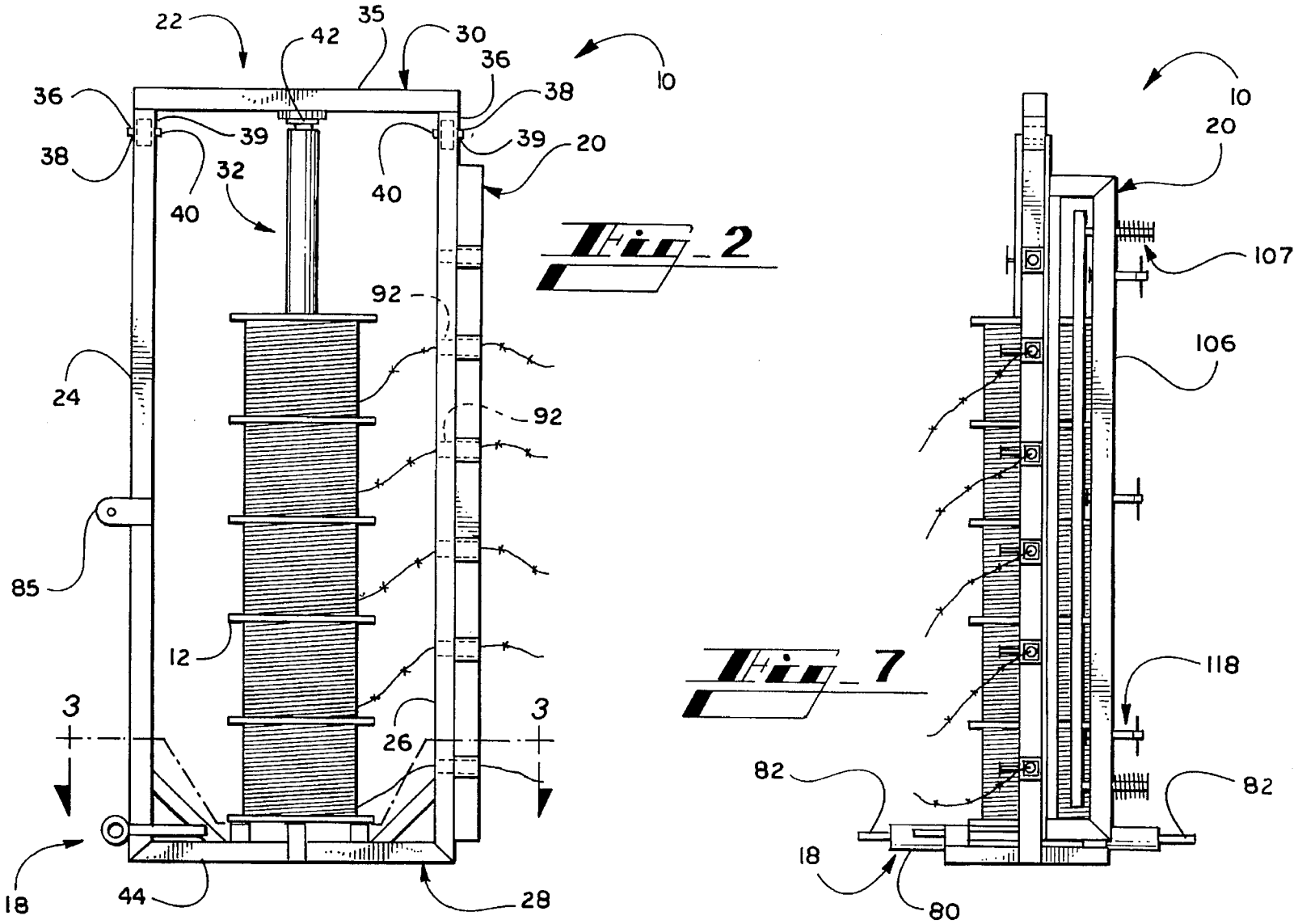
FIG. 2 is a side elevation of the dispenser shown in FIG. 1*b* separated from the farm tractor T.
FIG. 7 is rear elevation view of the dispensing and installation device shown in FIG. 2.

Looking now at FIG. 2 there is shown a dispenser 10 detached from the tractor T and set-up to dispense a complement of five strands of barbed wire fencing from five balls of barbed wire. The wire support assembly 15 includes a rectangular support frame 22 having opposed upstanding side members 24 and 26 interconnected by a lower support structure 28 and an upper support structure 30. The dispensing apparatus also includes a spindle assembly 32 which is mounted for rotation about a substantially vertical spindle rotation axis between the lower and upper support structures 28 and 30.

In the preferred embodiment of the present invention the side members 24 and 26 of the support frame 22 are fabricated of rectangular cross-section metal tubing, although other materials and configurations may be equally suitable. The upper support structure 30 includes an upper beam 35 which is fabricated of a section of rectangular metal tubing and is detachably secured to upper ends 36 of the side members 24 and 26. The upper beam 35 is made to be detachable with the upper ends 36 by providing metal stubs 38 secured to and extending from the side members 24 and 26 at the upper end 36. Receiving sleeves 39 for receiving the projecting ends of the metal stubs 38 are attached to and extend perpendicularly from the opposed ends of the upper beam 35. Release pins 40 are adapted to fit through cooperating apertures defined in the stubs 38 and the receiving sleeves 39 to fixedly secure the upper support structure 30 to the side members 24 and 26. An upper spindle bearing 42 is mounted at a mid-portion of the upper beam 35. The upper spindle bearing 42 supports the spindle assembly 32 for rotation about the spindle rotation axis. The upper spindle bearing 42 is a conventional flange bearing attached to the upper beam 35 so that the bearing rotation axis is substantially vertical and perpendicular to the upper beam 35.

Figure 3:
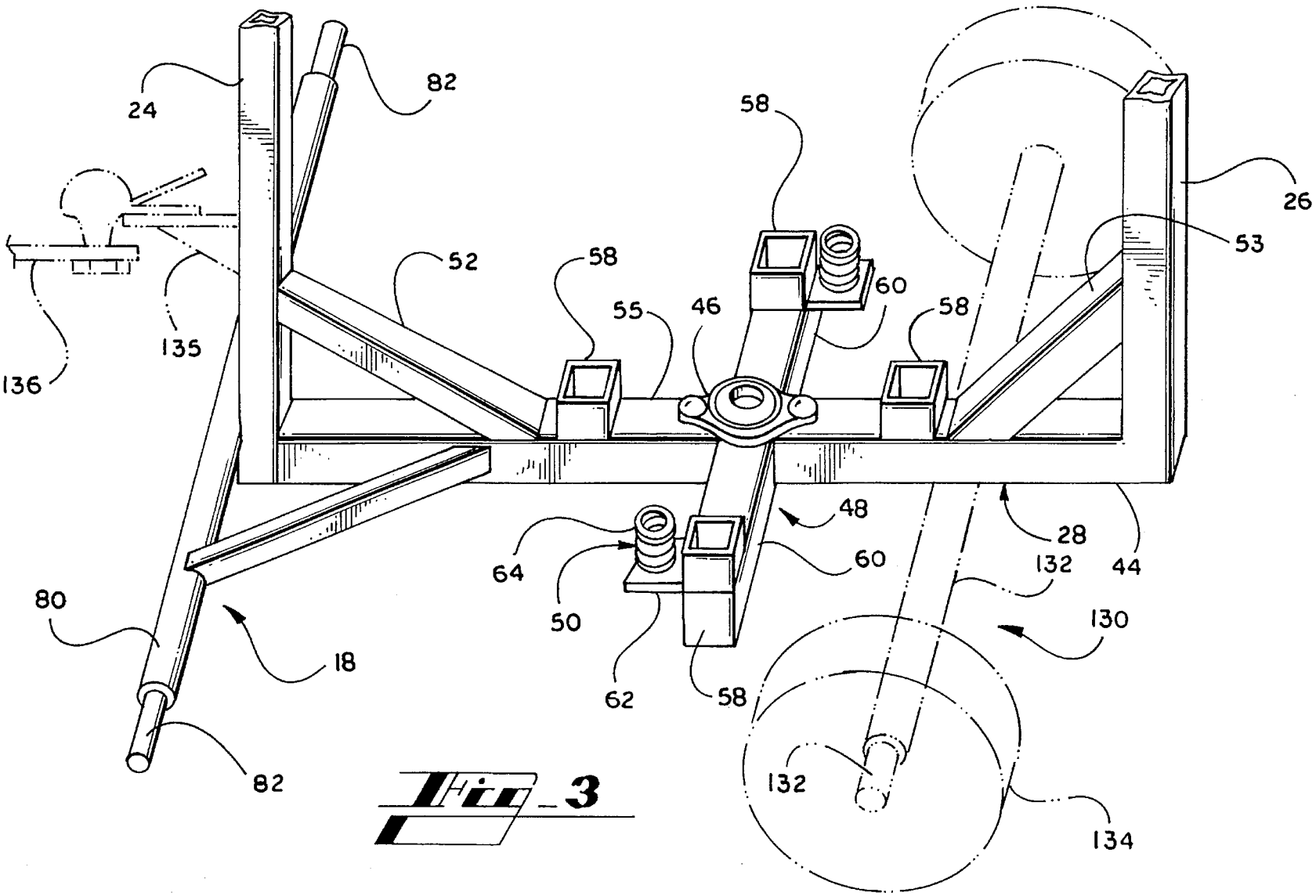
FIG. 3 is a partial perspective view taken along lines 3—3, shown in FIG. 2.

Looking now at FIG. 3, the lower support structure 28 includes a lower beam 44, a lower spindle bearing 46, a spindle stabilizer assembly 48 and a drag assembly 50. The lower beam 44 comprises an elongate metal rectangular tube having its opposed ends attached to the lower ends of the side members 24 and 26. Because the lower support structure 28 carries the weight of the wire fencing units and the spindle assembly 32, which can exceed five hundred pounds fully loaded, the lower beam 44 is strengthened by braces 52 and 53. The lower spindle bearing 46 is mounted at the mid-portion of an upper surface 55 of the lower beam 44 and has a rotation axis coincident with the rotation axis of the upper spindle bearing 42. The lower spindle bearing 46 is a thrust bearing for supporting the spindle assembly 32 for rotation about the spindle rotation axis.

The spindle stabilizer assembly 48 is mounted to the lower beam 44. The spindle stabilizer assembly 48 stabilizes the spindle assembly 32 when the spindle assembly 32 is engaged with the lower spindle bearing 46 but is not engaged or supported laterally by the upper spindle bearing 42, such as when the upper support structure 30 is not engaged with the side members 24 and 26. This condition occurs when the spindle assembly 32 is being loaded with wire fencing as will be explained in more detail below. The spindle stabilizer assembly 48 includes two pairs of opposed stabilizer blocks 58, a first pair being mounted along the upper surface 55 of the lower beam 44, and a second pair mounted on a pair of stabilizer outriggers 60 which are attached to the lower beam 44 and extend substantially perpendicular to the lower beam 44 and horizontal to the ground.

The stabilizer outriggers 60 also support the drag assembly 50. The drag assembly 50 includes angle brackets 62 mounted at distal ends of the stabilizer outriggers 60. Each angle bracket 62 mounts a compression spring 64 which is adapted to engage portions of the spindle assembly 32. The engagement of the springs 64 with the spindle assembly 32 is effective to prevent the spindle assembly 32 from overrunning and dispensing excess amounts of fencing.

Figure 4:
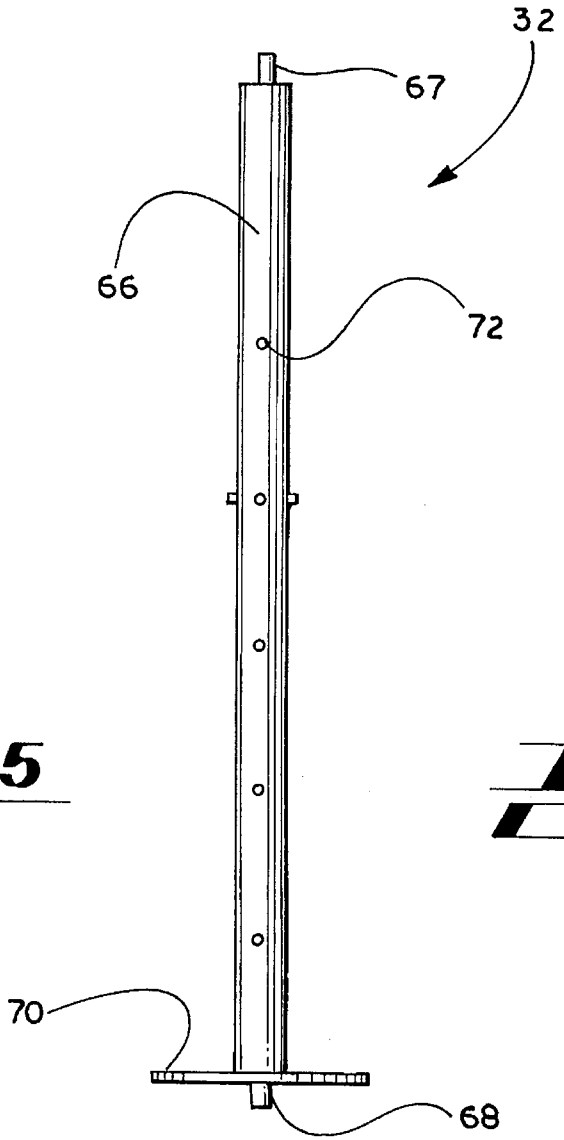
FIG. 4 is a side elevation view of the spindle assembly shown in FIG. 2.

The spindle assembly 32 is shown without fencing material disposed about it in FIG. 4. The spindle assembly 32 includes an elongate spindle tube 66 with upper and lower stub axles 67 and 68, respectively, mounted in and extending from opposing ends of the spindle tube 66. The stub axles 67 and 68 engage the upper and lower spindle bearings 42 and 46, respectively, of the wire support assembly 15 to support the spindle tube 66 for rotation within the support frame 22.

The spindle assembly 32 also includes a wire fencing unit support plate 70 which supports the wire fencing units carried by the spindle assembly 32. The support plate 70 is rigidly attached to the lower end of the spindle tube 66 and thus rotates with it.

The spindle assembly 32 is installed in the support frame 22 by first removing the release pins 40 and then removing the upper beam 35. The lower stub axle 68 of the spindle assembly 32 is inserted into the lower spindle bearing 46 and then the upper beam 35 is repositioned so that the upper stub axle 67 engages the upper spindle bearing 42 as the stubs 38 seat within the receiving sleeves 39 of the upper support assembly 30. When the upper support structure 30 is disengaged from the side members 24 and 26, the spindle assembly 32 is supported against tipping by the spindle stabilizer blocks 58 which engage the lower surface of the support plate 70. This is helpful when the wire fencing units are loaded onto the spindle tube 66 with the spindle assembly 32 engaged with the support frame 22. Alternatively, the spindle assembly 32 can be loaded with fencing material with the spindle assembly 32 disengaged from the support frame 22 by first removing the spindle assembly 32 from the support frame 22 and then loading the fencing material onto the spindle tube 66. The loaded spindle assembly 32 is then remounted onto the support frame 22.

When the spindle tube 66 is supported at its ends by the upper and lower spindle bearings 42 and 46, there is no engagement of the lower support plate 70 and the stabilizer blocks 58. There is, however, engagement between the upper ends of the compression springs 64, of the drag assembly 50, against the lower surface of the support plate 70. When the dispensing apparatus 10 is being operated to pay out wire fencing, the spring engagement against the support plate 70 causes a drag force against the support plate 70. The drag force is effective to prevent uncontrolled rotation of the spindle assembly 32. Uncontrolled rotation of the spindle assembly 32 usually results from sudden decreases in the traverse velocity of the tractor T. Momentum stored in the rotating spindle assembly and wire units mounted on the spindle assembly would cause the wire to continue to pay-out at a rate exceeding the tractor's traverse rate. The excess wire could payout uncontrolled along the ground or cause coils of wire, particularly those of the barbed wire balls, to fall from the wire balls or rolls. The excess wire could even cause a "bird nest" or backlash of loose coils which would have to be untangled by hand. By applying a drag force to the support plate 70 the angular momentum of the rotating spindle assembly 32 is effectively dissipated thereby preventing problems associated with sudden decreases in traverse velocity.

Figure 5:
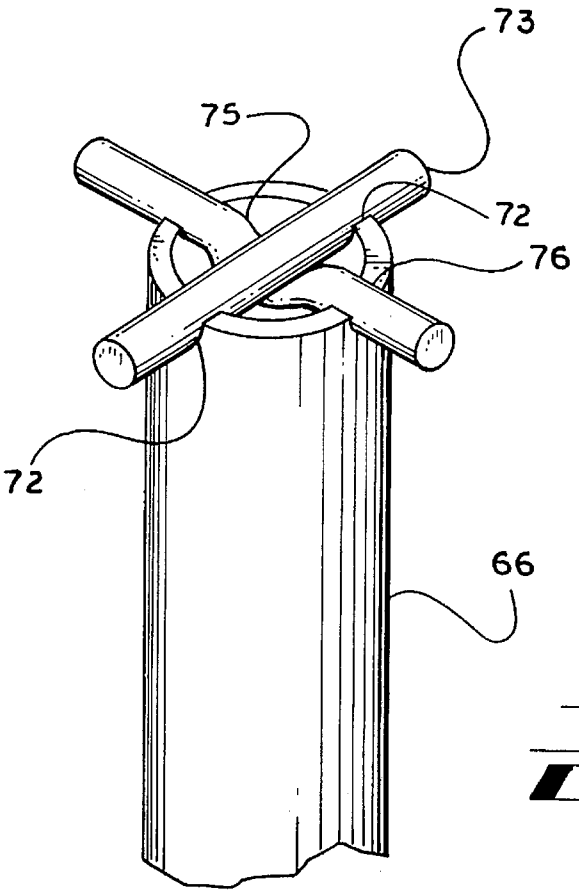
FIG. 5 is a perspective view, shown in partial cross section, of the spindle of the spindle assembly shown in FIG. 4 showing the insertion of support pins.

The spindle tube 66 of the spindle assembly 32 defines pairs of adjustment apertures 72 which are shown in FIGS. 4 and 5. The adjustment apertures 72 define axes which are orthogonally disposed to one another and intersect in a horizontal plane. The pairs of apertures 72 are located at predetermined locations along the length of the spindle tube 66. The adjustment apertures 72 are adapted to receive pairs of supports pins 73, one of the pair of pins 73 being provided with a clearance crook 75 to provide clearance between the two pins 73 when they are inserted through the pairs of cooperating apertures 72, as shown in FIG. 5. The pins 73 are sized so that when inserted through the apertures 72, their opposed ends extend away from the outer sidewall surface of the spindle tube 66. The pins 73 are further provided with notches 76 which are engagable with portions of the sidewall of the spindle tube 66 adjacent the apertures 72 so the pins 73 do not slide unintended from the apertures.

Figures 6, 10:
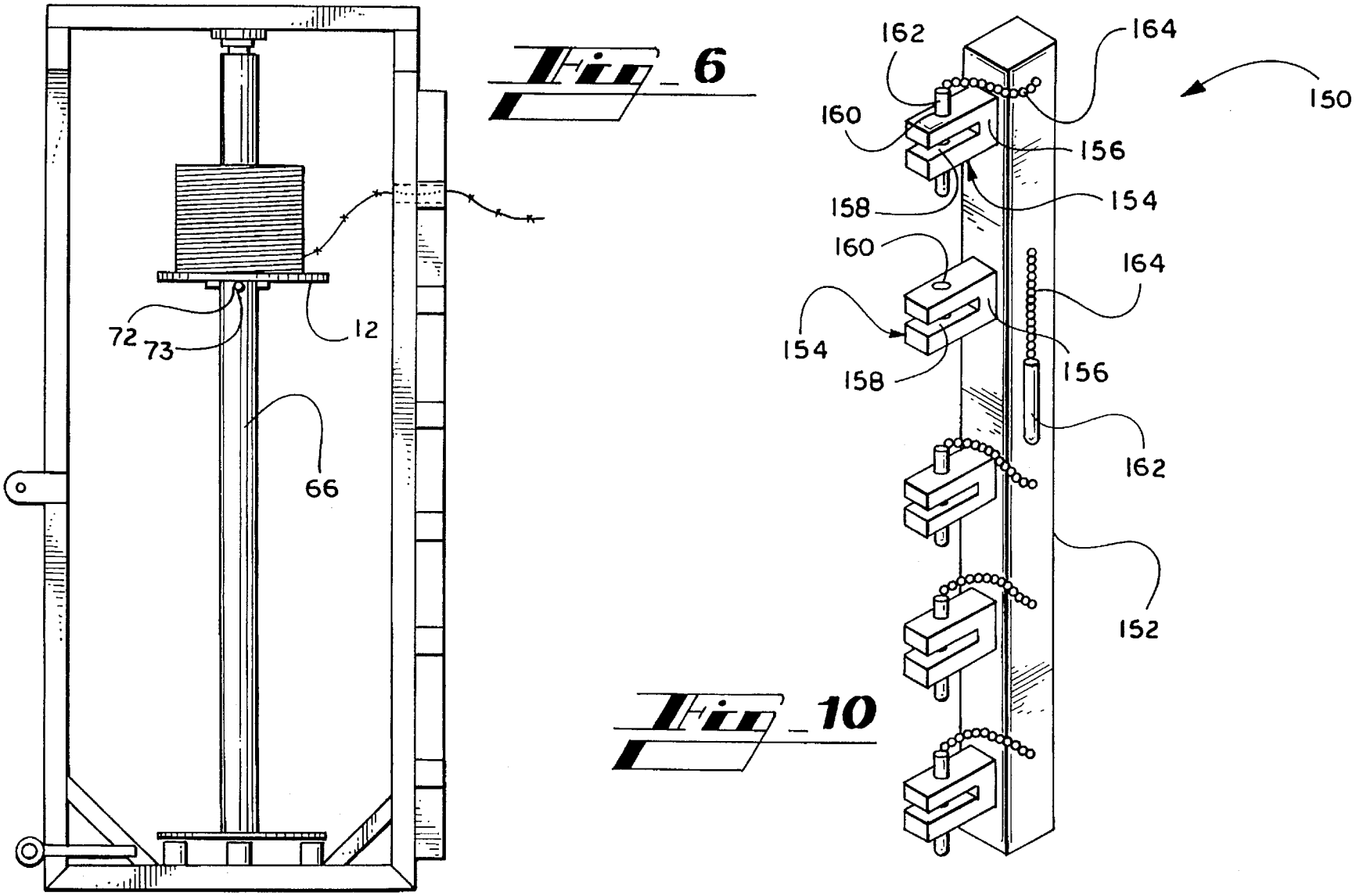
FIG. 6 is a side elevation view showing a single ball of barbed wire loaded at an upper end of the spindle assembly.
FIG. 10 is a perspective front view of a fencing organizer according to an embodiment of this invention.

The apertures 72 and pins 73 are provided for supporting wire fencing units on separator plates 12 at selected positions above the support plate 70, an example of which is shown in FIG. 6. Supporting wire fencing units at selected positions on the spindle tube 66 facilitates stringing wire fencing at a particular position on the fence posts P. Thus, for example, if it is desired to add a single course of stranded fencing only, a course of barbed wire for example, at an uppermost portion of the fence posts, the dispenser 10 could be adapted to dispense the single course at the desired course installation height. In this case the dispenser 10 would be adapted to support the ball of barbed wire at the desired height on the spindle tube 66, by first inserting a pair of support pins 73 through the uppermost apertures 72, as shown in FIG. 6. Then a separator plate 12 is placed on the spindle tube 66 and moved down the tube 66 until it engages the ends of the pins 73 extending from the tube 66. A ball of barbed wire fencing is placed about the spindle tube 66 and is lowered into supported relation with the upper surface of the separator plate 12. The barbed wire fencing material can then be disposed along the line of fence posts P as described below.

As discussed previously, the separator plates 12 are used for separating adjacent wire fencing units placed about and supported on the spindle tube 66. The use of separator plates 12 is necessary for two reason. The first reason for using separator plates 12 is to stabilize the coils of wire fencing on the balls and/or rolls of wire fencing. Adjacent balls and rolls of wire may become entangled during wire fencing pay-out, particularly when a coil drops from an upper ball or roll to a lower ball or roll of wire fencing when tension in the payed-out wire fencing is reduced and the wire fencing goes slack. Therefore, a support plate 12 placed between adjacent wire units help to stabilize the coils on the rolls or balls of wire fencing by separating the wire and acting as a flange element to control movement of the wire fencing during payout.

The second reason for using separator plates 12 to support the wire fencing units is to allow independent rotation of adjacent units of fencing material to prevent the rotation of one wire fencing unit from interfering with the rotation of adjacent wire fencing units. It is important to realize that, although the linear payout of wire from the spindle assembly 32 is substantially identical for all of the fencing wire units disposed about the spindle assembly 32, the rotational velocity of the individual wire units will often vary. This variation in rotational velocity results because the mean diameter of adjacent wire fencing units may be, and usually is, different. The rate at which wire is payed-out from a wire unit is inversely proportional to the unit's angular velocity. Therefore, a stranded wire fencing ball having a small mean diameter will rotate at a higher angular velocity than a stranded wire fencing ball having a large diameter ball, at a given pay-out rate. Thus, the wire fencing units must be provided with the capability to rotate independently of adjacent wire units if a complement of wire fencing is to be payed-out from a single rotating shaft. The change in rotational velocity at a given payout rate is due to the depletion of wire fencing from the unit which results in a decreasing wire unit mean diameter. The diameter depletion rate depends on, among other things, the type of wire fencing and the package configuration of the wire unit. For example, among commercially available fencing, a full length (new) ball of barbed wire is 1,320 feet, whereas, a full length (new) roll of field wire fencing is 330 feet. These are standard lengths commonly available from wire fencing manufacturers. The outside diameter of a new ball of barbed wire is approximately thirteen inches and the outside diameter of the new roll of field fencing is approximately seventeen inches. Thus, it will be appreciated that the field fencing roll will rotate, initially, at an angular velocity less than the angular velocity of the barbed wire ball, for a given payout rate. The angular velocities of the roll and ball change as the wire fencing material depletes, and, just before the field wire fencing roll is fully depleted, the field wire roll is rotating substantially faster than the barbed wire ball which still contains nearly 1000 feet of barbed wire fencing.

If no means were provided to allow the adjacent wire fencing units to rotate independently of one another, the adjacent wire fencing units would tend to snag each other and inhibit or prevent the smooth pay-out of wire along the fence line. The separator plates 12 disposed between adjacent wire fencing units allow the wire fencing units to rotate and slip freely relative to each other without encumbering the payout of any other wire fencing units from the dispenser 10. Also, the drag forces of the springs 64 on the plate 70 maintain the spindle assembly rotational velocity at or below the most slowly rotating wire unit.

Referring now to FIGS. 1 and 3, the translation support assembly 18 includes a cross member 80 attached to the side frame member 24 by conventional means including welding. The cross member 80 is generally an elongated tubular or solid shaft with engaging pins 82 extending from the opposing ends. The engaging pins 82 are adapted to engage mounting apertures 83 provided in lower support arms 84 of the hitch arrangement H carried by the tractor T. This hitch arrangement H is commonly referred to as a three point hitch, which refers to the configuration of the hitch which includes three points of contact with the supported apparatus. This is a standard mounting system for mounting various farm equipment to a tractor, including mowing equipment, plows and furrowers. A third point of attachment is accomplished by a pivot point connector plate 85 attached to the side member 24. A pivot shaft 86 of the three point hitch H attaches to the connector plate 85 by a pivot pin 87 inserted through cooperating apertures 78 and 79 in the connector plate 85 and pivot shaft 86, respectively. The three point hitch H is arranged to be capable of moving the dispenser 10 up and down while the lower beam 44 remains substantially parallel to the ground by the compound motion of raising the hitch support arms 84 and extending or retracting the pivot shaft 86. The dispenser 10 is pivoted by holding the hitch support arms 84 stationary and extending or retracting the pivot shaft 86.

The dispenser 10 may be supported and translated by means other than a tractor T and a three point hitch H. For example, as is shown in FIG. 3 in phantom lines, a wheel and axle assemble 130 may be adapted to the support frame 22 to support the dispenser 10 for translation. The wheel and axle assembly 130 includes a stub axle assembly 132 attached along a lower surface of the cross member 44. Wheels 134 are attached for rotation about the stub axles 132 in a conventional manner. A hitch tongue 135 is attached to the side member 24 and is adapted to engage a ball mount 136 carried by an alternative pulling vehicle, which may include a pick-up truck or an all terrain vehicle.

The fence brake and guide arrangement 20 is provided to guide the dispensed wire in a preferred payout pattern and to clamp the wire fencing to isolate pulling tension from the rolls or balls prior to stretching and attaching the fencing to the fence posts P. Looking at FIGS. 2, 7, 8 and 9, it will be seen that the fence brake and guide assembly 20 includes a stranded wire guide and clamp assembly 88 and a woven wire guide and clamp assembly 90.

The stranded wire guide and clamp assembly 88 includes a plurality of guide apertures 92 arranged along and extending through the side member 26. Each guide aperture 92 is fitted with a guide eyelet 93 which may be fabricated of hardened steel or a ceramic material and is useful for preventing wear of the guide aperture 92 and to allow the wire strand to travel smoothly through the guide aperture 92. The guide apertures 92 are spaced apart and arranged at points along the side member 26 that correspond to the mid points of standard size units of balled fencing, stacked one on top of another, which usually measure about ten to twelve inches in height. A sufficient number of guide apertures 92 are provided and arranged along the side member 26 to accommodate most foreseeable complements and configurations of wire fencing units dispensed by the apparatus 10.

Figure 8:
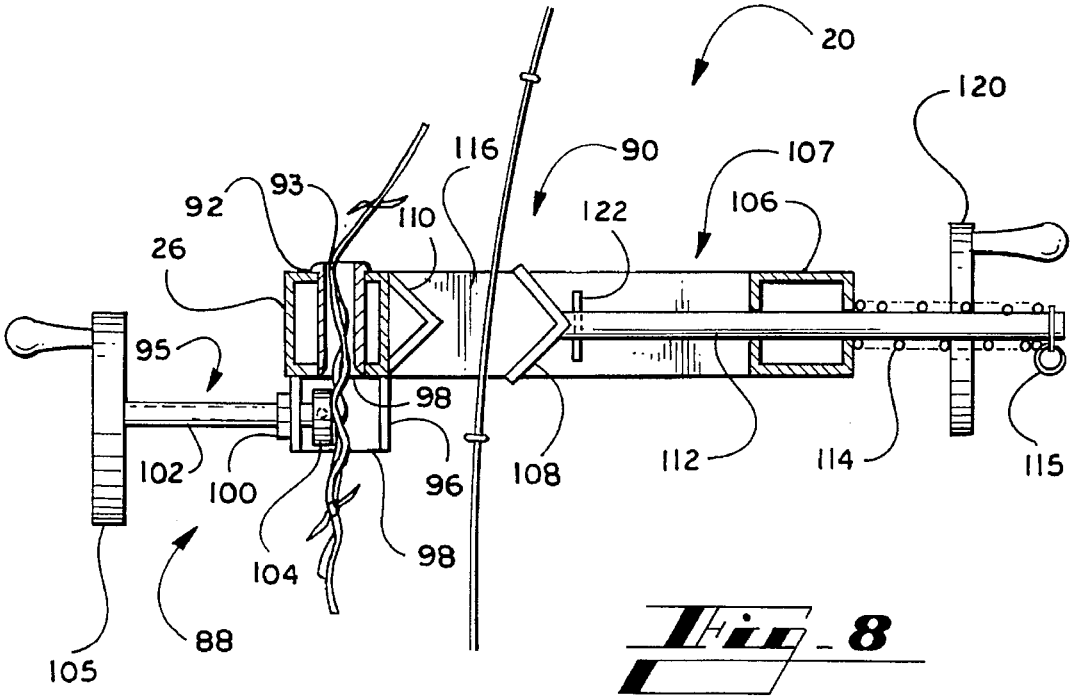
FIG. 8 is a top elevation view, shown in partial cross section, of the fence brake and guide assembly that form part of the apparatus shown in FIG. 2.
Figure 9:
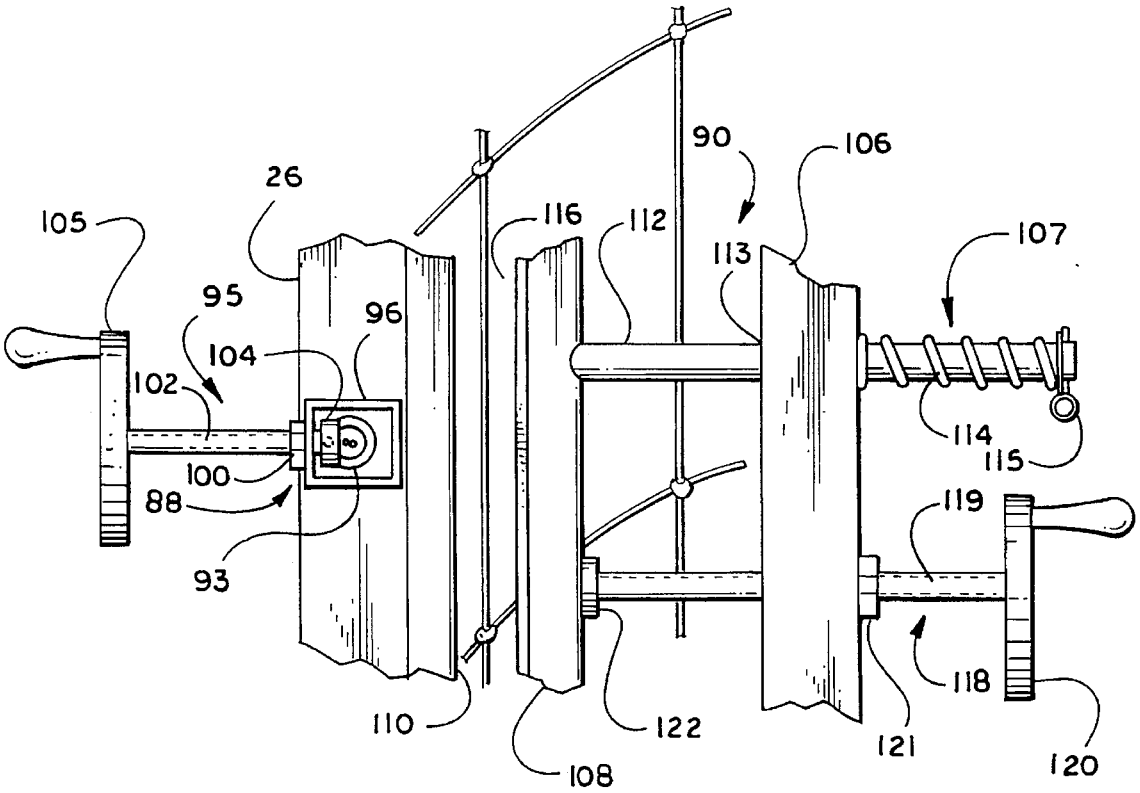
FIG. 9 is a segmentary side elevational view of the fence brake and guide assembly shown in FIG. 8.

Each guide aperture 92 has associated with it a cooperating strand clamp assembly 95 for clamping a strand of stranded wire fencing passing through the aperture 92, which is shown in detail FIGS. 8 and 9. Each strand clamp assembly 95 includes a clamp housing 96 attached to the side member 26. The clamp housing 96 defines opposed pass-through openings 98 which allow a wire strand passing from the eyelet 93 to pass through the strand clamp assembly 95. The clamp housing 96 also defines a threaded clamp aperture 100 for receiving a threaded clamping shaft 102. The threaded clamping shaft 102 includes a swivel mounted engaging pad 104 at the end of the clamping shaft 102 disposed within the strand clamp housing 96, and a speed wheel 105 mounted at the opposite end of the clamp shaft 102 to facilitate rotating the clamping shaft 102. The clamp assembly 95 is caused to clamp the wire strand passing through the clamp housing 96 by turning the speed wheel 105 to advance the clamping pad 104 toward the wire strand passing through the clamping assembly. When the stranded wire fencing is clamped in the housing 96, the tension in the payed-out stranded wire fencing is isolated from the stranded wire fencing remaining on the unit and supported on the spindle assembly 32.

As shown in FIGS. 7 and 9, the woven wire guide and clamp assembly 90 includes a "U" shaped clamp frame 106 attached to the side member 26, and a fence clamp assembly 107. The fence clamp assembly 107 includes a vertically extending, moveable clamp bar 108 adapted to nest with an opposed, vertically extending fixed clamp bar 110. The movable and fixed clamp bars 108 and 110 are fabricated of metal angle iron having legs displaced at ninety degrees from one another. The movable clamp bar 108 is supported by a plurality of slide bars 112 extending through apertures 113 defined along the clamp frame 106. Compression springs 114 are coaxially disposed about the slide bars 112 and retained by slide bar spring pins 115. The compression springs 114 urge the moveable clamp bar 108 away from nesting engagement with the fixed clamp bar 110 to provide a pass-through opening 116 between the movable and fixed clamp bars 108 and 110 through which woven wire fencing is caused to pass. The moveable clamp bar 108 is moved toward engagement with the fixed clamp bar 110 by threaded rod assemblies 118. The threaded rod assemblies 118 are similar to the threaded shaft 102 of the strand clamping assembly 88. Each threaded rod assembly 118 includes a threaded rod 119 received in a threaded aperture 121 defined in the "U" shaped clamp frame 108, a speed wheel 120 at the outside end of the threaded rod 119 and an engaging jaw 122 attached to the inside end of the threaded rod 119.

As each threaded rod 119 is turned to advance the jaw 122 toward the moveable bar 108, the jaws 122 engage the moveable bar 108 and cause it to advance toward the stationary bar 110. Woven wire fencing positioned within the pass-through opening 116 is effectively clamped therebetween and the tension in the payed-out woven wire fencing may be isolated from the woven wire fencing remaining on the roll and supported on the spindle assembly 32. As the moveable bar 108 is moved into more compressive engagement with the woven wire fencing, the woven wire fencing will bend to conform to the angular profile of the bars 108 and 110, further enhancing the grip of the clamp assembly 90 on the woven wire fencing. The woven wire guide and clamp assembly 90 extends adjacent the entire length of the wire spindle 66 so that it will be capable of clamping woven wire fencing regardless of its position upon the spindle assembly 32.

The installation and fencing device further includes a dispensed wire installation post assembly 150 which is shown in FIG. 10. The installation post assembly 150 is useful for organizing the payed-out wire fencing prior to attaching the fencing to the fence posts P. The installation post assembly 150 includes an elongate post 152 and a plurality of fence retainers 154. The fence retainers 154 are arranged along the post 152 in spaced apart relation at intervals corresponding to wire spacing encountered in typical fence installations. The fence retainers 154 include a retainer block 156 defining a slot 158 open along three adjacent sides of the retainer block 156. The retainer block 156 is affixed to the post 152 by welding or other means and oriented so that the slot 158 is perpendicular to the elongate axis of the post 152. The slot 158 is sized so that wire gauges of the sizes typically encountered in wire fencing material may be positioned within the slot. A width of three sixteenths of an inch is sufficient to accommodate most wire sizes. The retainer block also defines a pin aperture 160 formed in the retainer block 156 that passes through retainer block 156 perpendicular to the slot 158. A pin 162, tethered to the post 152 by a tether chain 164, is provided for inserting into the pin aperture 160. The pin 162 is provided to retain wire positioned in the slot 158 by positioning the wire in the slot 158 past the aperture 160 and then inserting the pin 162 into the aperture 160.

Set-up and Operation

A fence installation operation, often called a "stringing operation," for installing a complement of wire fencing along a line of fence posts includes, generally, the steps of loading wire fencing units destined to be strung along a line of fence posts onto a fencing dispenser and installation device, dispensing the wire fencing by paying the fencing out from the dispensing and installation device, stretching the payed-out wire fencing and then attaching the fencing to the fence posts.

The dispenser 10 is prepared to receive a desired complement of wire fencing units, by extracting the release pins 40 from the apertures 41 and then removing the upper support structure 30 by lifting it from engagement with the side members 24 and 26. The wire fencing units are loaded onto the spindle assembly 32 with the spindle assembly 32 residing supported within the lower spindle bearing 46, or the spindle assembly 32 may be removed from the frame 22 for loading. Several interchangeable spindle assemblies 32 may be prepared with the desired complement of wire fencing units to allow quick change-out during fencing installation. Alternatively, the interchangeable spindle assemblies 32 may be provided with alternative complements or configurations of wire fencing units for quick change-out when the fencing material requirements change during a run of fencing. Thus, for example, a complement of fencing including a lower course of electrified stranded fencing may be run along a line of posts up to the point where the fencing must cross a stream. When the dispensing apparatus comes within a predetermined distance of the stream an alternative complement of wire fencing units, not including the electrified strand, can be changed-out quickly and conveniently by substituting the spindle assembly supporting the former complement of fencing with another spindle assembly supporting the latter complement of fencing.

The procedure for loading the wire fencing units is described below for a common complement of fencing used for enclosing farm land and ranches which includes a course of field wire fencing flanked above and below by single strands of barbed wire fencing as is shown in FIG. 1. The loading procedure includes placing the first ball B1 of barbed wire fencing material onto the tube 66 and lowering it so that it rests on the lower support plate 70. The spindle tube 66 is sized to an outside diameter (OD) compatible with the central aperture in most commercially available rolls, balls and spools of fencing material, which is typically about four inches. A separator plate 12 is positioned over the tube 66 and supported atop the first barbed wire ball B1. Then the roll R1 of woven field fencing is placed over the tube 66 and supported on the upper surface of the separator plate 12. A second separator plate 12 is placed over the tube 66 and caused to rest on the upper portion of the woven field wire roll R1. A second ball B2 of barbed wire fencing is placed over tube 66 and supported upon the upper surface of the second separator plate 12. A third separator plate 12 may be placed on the upper surface of the upper ball B2 to help stabilize the barbed wire coils during pay-out. The upper support structure 30 is reassembled with the side members 24 and 26 and secured by reinserring the release pins 40 through the apertures 41.

Although the dispenser 10 requires no particular unwind direction of the wound fencing material units, it is important that all of the fencing material units disposed about the spindle tube 66, balls, rolls and spools alike, be placed on the spindle tube 66 so that all the units pay-out fencing material in the same rotational direction. Thus, the wire fencing may be loaded on the spindle tube 66 so that all the fencing material units rotate in either a clockwise direction or a counter-clockwise direction. As shown in FIGS. 1, 1*a* and 1*b*, the fencing material is mounted so that the spindle assembly turns clockwise with respect to the lower bearing. The use of the separator plates 12 between wire units would allow the dispenser to be operable even if the units were loaded such that they rotate in different directions during payout. This is possible because the plates allow the units to slip relative to one another regardless of their payout direction. However, this payout configuration may cause excessive friction on the separator plates 12 by the opposed rotation of the fencing units on the plates and will result in higher pulling forces necessary to be exerted by the tractor T. Also, to the extent that the ball B1 of barbed wire, shown supported on the support plate 70 in FIG. 1, slips with respect to the support plate 70, the spindle assembly could be supported without rotation by the support frame 22. Thus, the spindle tube 66 would act simply as a non-rotating arbor about which all the coiled wire fencing units rotate. This however, would cause considerable wear of the support plate 70 and result in higher pulling forces necessary to be exerted by the tractor T.

After the dispenser 10 is loaded with the desired complement of wire fencing material units, the upper support structure 30 is reinstalled by re-engaging the receiving sleeves 39 with the upstanding metal stubs 38 of the side members 24 and 26. The release pins 40 are re-inserted into the apertures 41 to secure the upper structure 30. The height of the dispenser 10 above the ground is adjusted by raising the hitch support arms 84 and the attitude of the dispenser 10 is adjusted by moving the pivot shaft 86 so that the spindle tube 66 resides substantially vertically oriented.

The free ends of each of the barbed wire balls are fed through the stranded wire guide eyelets 93 of the stranded wire guide and clamp assembly 88. The free end of the woven field wire fencing is fed through the pass-through opening 116 of the woven wire guide and clamp assembly 90.

The free wire ends emerging from the guide eyelet 93 and the pass-through opening 116 are attached to the end post of the line of fence posts P. Wire fencing pay-out is commenced by moving the dispenser 10 along the ground and past the line of fence posts P. As the fencing pays-out from the dispenser 10, the spindle assembly 32 rotates at a nominal angular velocity which is controlled by the frictional forces of the compression springs 64 of the drag assembly 50 on the lower surface of the lower support plate 70. The angular velocity of the spindle assembly 32 will generally not be the same as the angular velocity of all of the balls or rolls of fencing material mounted on the spindle tube 66. The angular velocity of the wire fencing units is determined by the desired linear pay-out rate of the wire fencing, which is equal to the traverse rate of the tractor T, and the mean diameter of the wire units mounted on the spindle assembly 32, at any point in time during the pay-out period. The separator plates 12 facilitate the differential rotation rates by allowing the rolls and balls of fencing to slip independently of and rotate relative to each other. Therefore, the balls and rolls of fencing material are free to rotate at their required angular velocities.

A catenary develops in the wire as the fencing material is payed-out. Eventually, the wire material may engage the ground at which point it is good practice to install dispensed wire installation post assemblies 150 at desired intervals along the payed-out wire fencing. The dispensed wire installation post assemblies 150 facilitate later attachment of the wire fencing to the posts P by preventing tangling and by supporting the wire during stretching. Each installation post assembly 150 also acts as a spacing device for defining points of attachment of the wire fencing to the posts P and the spacing between the courses of wire fencing. A installation post assembly 150 is attached to the payed-out fencing by removing the retaining pins 162 and then placing the individual wire strands or horizontal elements of the woven wire fencing into the slots 158 of the retaining blocks 156. After a desired length of fencing is payed-out and several fencing organizers are installed, it is good practice to prepare the payed-out wire for attachment to the fence posts P.

Prior to attaching the payed-out wire to the fence posts P, the excess wire fencing is removed from the payed-out wire and the fencing is stretched. The excess payed-out fencing is taken up back onto the wire units by manually rotating the barbed wire balls B1 and B2, and the woven wire fencing roll R1 in a direction opposite the pay-out direction. Tension in the payed-out fencing material is isolated from the wire fencing remaining on the roll R1 and balls B1 and B2 on the dispenser 10 by engaging the strand clamp and fence clamp assemblies 95 and 107, respectively, with the barbed wire and woven wire fencing materials. Wire clamping also immobilizes the payed-out fencing with respect to the dispenser 10. The strand clamp assembly 95 is engaged with the barbed wire by rotating the speed wheel 105 to cause the engaging pad 104 to move toward the opposite side of the clamp housing 96. The woven wire fencing is clamped by the fence clamping assembly 107 by rotating the speed wheels 120 to cause the engaging jaws 122 to engage the moveable clamp bar 108 which advances the movable bar 108 toward the stationary bar 110 until the woven wire fencing is securely clamped. With the tension in the payed-out fencing material now isolated from the wire fencing material remaining on the spindle assembly 32, and the dispenser 10 incapable of further wire pay-out, the payed-out fencing material can be stretched.

The fencing is stretched by moving the tractor T, with the fencing material clamped to prevent additional pay-out of wire fencing from the dispenser, in the direction of pay-out, away from the end post. As the tractor T is moved for stretching, the tension in the payed-out fencing may increase non-uniformly course-to-course. This non-uniformity in tension may be due to the type of fencing being installed and variations in the actual amount of fencing paid out in each course of fencing material. If there is tension non-uniformity, one or more of the courses of fencing material will come to correct tension before the other courses come to correct tension. Thus, for example, the lower most course of barbed wire may be properly tensioned, and the upper course of barbed wire and the field fencing may be under-tensioned. In this case the lower most course of barbed wire would be attached to the fence posts first. The strand clamp assembly 95 associated with the now-attached barbed wire course is released from clamped engagement with the dispenser or the attached lower course of wire fencing can be cut. The tractor T is then moved to bring the remaining courses into correct tension. If the tension in the remaining courses is non-uniform, the correctly tensioned course is attached to the fence posts and then unclamped or cut as desired. The tractor T is moved similarly until all the courses are properly tensioned and are attached to the fence posts P. If the wire fencing courses were unclamped, rather than cut at the dispenser, the dispenser can be moved along another portion of the fence posts P and the organizing, stretching and attaching process is repeated until wire is depleted from dispenser 10.

The dispensing apparatus 10 may also be set-up and used for installing a single course of wire fencing to an existing fence system at a particular position along the line of fence posts. For example, if an existing installed fencing system includes a line of fence posts having a single course of woven wire fencing installed upon it, one or more courses of other fencing material, barbed wire or electric fencing wire for example, may be installed at a desired position on the posts. Assuming, for example, that it is desired to add a single course of wire along the upper most portion of the fence posts, above a previously installed woven wire course, the dispensing device 10 would be set up as shown in FIG. 7. The set up shown in FIG. 7 is accomplished by removing the upper support structure 30 as described above. Pairs of support pins 73, one having a clearance crook 75, are inserted through the upper apertures 72 below and adjacent to the point at which the ball is desired to be supported on the spindle tube 66. A separator plate 12 is installed over the spindle tube 66 and supported along the spindle tube 66 by the end portions of the support pins 73 extending from the spindle tube 66. A ball of barbed wire or electric strand fencing is selected and installed over the spindle tube 66 and supported on the separator plate 12 at the desired height for installation. The desired height at which the ball of barbed wire is to be supported on the spindle assembly 32 is generally, equal to the height at which the barbed wire or electric strand fencing will reside on the fence posts P when installed. The barbed wire or electric wire strand is then installed along the line of fence posts P, stretched and attached to the fence posts, as described above.

While the present invention in its various aspects has been described in detail with regard to preferred embodiments thereof, it should be understood that variations, modifications and enhancements can be made to the disclosed apparatus and procedures without departing from the scope of the present invention as defined in the appended claims.

We claim:

1. A wire fencing dispensing and installation apparatus adapted to be drawn by a conveyance for dispensing wire fencing along a line of fence posts from coiled wire fencing units carried by said apparatus, said apparatus including:

a plurality of wire fencing units each having a unit aperture and a free wire fencing end attachable to a post of the line of fence posts;

a translation support engagable with the conveyance and adapted to be drawn thereby;

a wire support assembly attached to the translation support and including:
a support frame; and a spindle assembly, supported by said support frame and comprising a wire fencing unit support plate for supporting the plurality of coiled wire fencing units and an upstanding spindle coaxially receiving the coiled wire fencing units by extending through the unit apertures of the coiled wire fencing units, the wire fencing support plate attached to a lower end of the spindle; and at least one separator plate disposed between and separating adjacent coiled wire fencing units, one of the adjacent coiled wire fencing units resting on the wire fencing unit support plate and the at least one separator plate positioned over the spindle and atop the one of the coiled wire fencing units, the at least one separator plate having an upper surface and another of the adjacent coiled wire fencing units positioned over the spindle and supported on the upper surface of the at least one separator plate, wherein said apparatus is capable of simultaneously dispensing wire fencing from the plurality of coiled wire fencing units supported by said spindle assembly by uncoiling the wire fencing from the coiled wire fencing units as the coiled wire fencing units are caused to rotate relative to said support frame in response to the conveyance moving said apparatus past the line of fence posts and said at least one separator plate allowing adjacent ones of the coiled wire fencing units to rotate relative to one another in response to said apparatus being conveyed by said conveyance.

2. The apparatus of claim 1 wherein the plurality of coiled wire fencing units comprises a ball of stranded wire fencing and said ball of stranded wire fencing is adapted to fit coaxially about said upstanding spindle of said spindle assembly.

3. The apparatus of claim 1 wherein the plurality of coiled wire fencing units comprises a spool of stranded wire fencing and said spool of stranded wire fencing is adapted to fit coaxially about said upstanding spindle of said spindle assembly.

4. The apparatus of claim 1 wherein the plurality of coiled wire fencing units comprises a roll of field fencing and said roll of field fencing is adapted to fit coaxially about said upstanding spindle of said spindle assembly.

5. The apparatus of claim 1 wherein said translation assembly comprises a hitch assembly engagable with a three point hitch carried by the conveyance.

6. The apparatus of claim 1 further comprising a wheel and axle assembly operatively connected to said support frame for supporting said support frame for translation along the ground past the line of fence posts, and wherein the translation support further comprises a hitch tongue engagable with a hitch ball carried by the conveyance for pulling said dispensing apparatus along the ground by the conveyance past the line of fence posts.

7. A wire fencing dispensing and installation apparatus adapted to be drawn by a conveyance for dispensing wire fencing along a line of fence posts from coiled wire fencing units carried by said apparatus, each coiled wire fencing units being configured to define a unit aperture through the wire fencing unit and having a free wire fencing end attachable to a post of the line of fence posts, said apparatus including:

a translation support engagable with the conveyance and adapted to be drawn thereby; and a wire support assembly attached to the translation support and including:

a support frame; and a spindle assembly, supported by said support frame and comprising a wire fencing unit support plate for supporting the plurality of coiled wire fencing units and an upstanding spindle adapted to coaxially receive the coiled wire fencing units by extending through the unit apertures of the coiled wire fencing units, wherein said apparatus is capable of simultaneously dispensing wire fencing from the plurality of coiled wire fencing units supported by said spindle assembly by uncoiling the wire fencing from the coiled wire fencing units as the coiled wire fencing units are caused to rotate relative to said support frame in response to the conveyance moving said apparatus past the line of fence posts and wherein said spindle assembly is a rotating spindle assembly and said apparatus further includes a drag assembly comprising a compression spring engagable with the wire fencing unit support plate for providing a drag force effective to control the dispensing of wire fencing from the coiled wire fencing units supported by the spindle assembly as said apparatus is moved past the line of fence posts.

8. A wire fencing dispensing and installation apparatus adapted to be drawn by a conveyance for dispensing wire fencing along a line of fence posts from coiled wire fencing units carried by said apparatus, each coiled wire fencing units being configured to define a unit aperture through the wire fencing unit and having a free wire fencing end attachable to a post of the line of fence posts, said apparatus including:

a translation support engagable with the conveyance and adapted to be drawn thereby; and a wire support assembly attached to the translation support and including:

a support frame; and a spindle assembly, supported by said support frame and comprising a wire fencing unit support plate for supporting the plurality of coiled wire fencing units and an upstanding spindle adapted to coaxially receive the coiled wire fencing units by extending through the unit apertures of the coiled wire fencing units, wherein said apparatus is capable of simultaneously dispensing wire fencing from the plurality of coiled wire fencing units supported by said spindle assembly by uncoiling the wire fencing from the coiled wire fencing units as the coiled wire fencing units are caused to rotate relative to said support frame in response to the conveyance moving said apparatus past the line of fence posts and wherein the apparatus further includes a dispensed wire installation post assembly to prevent tangling and to maintain the order of the wire fencing dispensed from the coiled wire fencing units as said dispensing apparatus is moved past a line of fence posts, said wire installation post assembly comprising an elongate post and a plurality of retainer assemblies, said retainer assemblies being arranged along said elongate post in spaced apart relation and capable of being selectively engaged with portions of the dispensed wire fencing prior to attaching the dispensed wire fencing to the line of fence posts and alternatively disengaged from the dispensed wire fencing, each retainer assembly comprising a retainer block having a slot for receiving dispensed wire fencing and a pin for selectively retaining the dispensed wire fencing in the slot.

9. A method of dispensing and installing wire fencing from coiled wire fencing units having a free wire fencing end along a line of fence posts, said method comprising the steps of:

providing a fencing dispensing apparatus comprising a support frame, a spindle assembly supported by the support frame and comprising a wire fencing unit support for supporting a plurality of coiled wire fencing units and an upstanding spindle adapted to coaxially receive and support a plurality of coiled wire fencing units thereon;

placing a plurality of coiled wire fencing units about the spindle to be supported by the spindle assembly;

placing a separator plate having an upper surface between adjacent ones of the coiled wire fencing units supported by the spindle assembly for separating the adjacent coiled wire fencing units so that one of the adjacent coiled wire fencing units rests on the wire fencing unit support plate, the separator plate is positioned atop the one of the adjacent coiled wire fencing units, and another of the adjacent coiled wire fencing units is positioned over the spindle and supported on the upper surface of the separator plate, securing the free wire fencing end of each of the coiled wire fencing units to a fence post of the line of fence posts; and conveying the dispensing apparatus along the line of fence posts in a dispensing direction to simultaneously dispense the wire fencing from the coiled wire units supported by the spindle assembly, the separator plate allowing adjacent ones of the coiled wire fencing units to rotate relative to one another in response to said apparatus being conveyed by said conveyance.

10. The method of claim 9 wherein the coiled wire fencing units comprise a ball of stranded wire fencing.

11. The method of claim 9 wherein the coiled wire fencing units comprise a roll of field wire fencing.

12. The method of claim 9 wherein the coiled wire fencing units comprise a spool of stranded wire fencing.

13. The method of claim 9 further including the steps of stretching the dispensed wire fencing and attaching the dispensed wire fencing to the line of fence posts, wherein the step of stretching the dispensed wire fencing including the substeps of:

braking portions of the dispensed wire to secure the dispensed wire relative to said support frame and prevent further payout of wire from the coiled wire units supported by the spindle assembly, and moving the conveyance in the dispensing direction so that the dispensed wire fencing is placed in a state of proper wire fencing tension.

14. The method of claim 1 wherein the spindle assembly rotates relative to the frame assembly and said method further includes the step of providing a drag force to the spindle assembly to control the dispensing of wire fencing from the coiled wire fencing units carried by the spindle assembly.

15. The method of claim 1 wherein the fencing dispensing apparatus further includes a dispensed wire fencing installation post having one or more retainer blocks selectably engagable with wire fencing, said method of further including selectively engaging a dispensed wire fencing installation post to the dispensed wire fencing before the step of attaching the dispensed wire to the posts of the line of posts to prevent tangling of the dispensed wire fencing.

16. A wire fencing dispensing and installation apparatus adapted to be drawn by a conveyance for dispensing wire fencing along a line of fence posts from coiled wire fencing units carried by said apparatus, each of the coiled wire fencing units being configured to define a unit aperture through the wire fencing unit and having a free wire fencing end attachable to a post of the line of fence posts, said apparatus including:

a translation support engagable with the conveyance and adapted to be drawn thereby; and a wire support assembly attached to the translation support and including:

a support frame; and a spindle assembly, supported by said support frame and comprising a wire fencing unit support for supporting the plurality of coiled wire fencing units and an upstanding spindle adapted to coaxially receive the coiled wire fencing units by extending through the unit apertures of the coiled wire fencing units, wherein said apparatus is capable of simultaneously dispensing wire fencing from the plurality of coiled wire fencing units supported by said spindle assembly by uncoiling the wire fencing from the coiled wire fencing units as the coiled wire fencing units are caused to rotate relative to said support frame in response to the conveyance moving said apparatus past the line of fence posts;

said fence clamping means further includes a stranded wire clamp and a field fencing clamp separate from the stranded wire clamp, said stranded wire clamp and said field fencing clamp being supported by said frame and adapted to independently and selectively engage respective portions of the dispensed wire fencing to prevent further dispensing of the wire fencing from the coiled wire units and to secure the dispensed wire relative to said frame;

the stranded wire clamp includes a clamp housing attached to the support frame and having a pass-through opening for allowing stranded wire to pass through the clamp housing, a threaded clamp aperture, and a threaded clamping shaft engaged in the threaded clamp aperture and selectively advanceable through the threaded clamp aperture for clamping the stranded wire within the clamp housing; and the field fencing clamp includes a clamp frame attached to the support frame, a movable clamp bar, an opposing fixed clamp bar, and means for moving the movable clamp bar into engagement with the opposing fixed clamp bar to clamp woven wire fencing therebetween.

* * * * *